US009757960B2

(12) United States Patent
Weglicki et al.

(10) Patent No.: US 9,757,960 B2
(45) Date of Patent: Sep. 12, 2017

(54) INKJET PRINTER WITH UV BULB SHUTTER SYSTEM INCLUDING MORE THAN ONE MOVABLE SHUTTER

(71) Applicant: AGFA GRAPHICS NV, Mortsel (BE)

(72) Inventors: Piotr Weglicki, Mortsel (BE); Martin De Kegelaer, Mortsel (BE); Konstantinos Karellas, Mortsel (BE)

(73) Assignee: AGFA GRAPHICS NV, Mortsel (BE)

( * ) Notice: Subject to any disclaimer, the term of this patent is extended or adjusted under 35 U.S.C. 154(b) by 0 days.

(21) Appl. No.: 15/107,488

(22) PCT Filed: Jan. 26, 2015

(86) PCT No.: PCT/EP2015/051437
§ 371 (c)(1),
(2) Date: Jun. 23, 2016

(87) PCT Pub. No.: WO2015/110619
PCT Pub. Date: Jul. 30, 2015

(65) Prior Publication Data

US 2016/0311234 A1 Oct. 27, 2016

(30) Foreign Application Priority Data

Jan. 27, 2014 (EP) ..... 14152614

(51) Int. Cl.

| | |
|---|---|
| ***B41J 11/00*** | (2006.01) |
| ***B41J 2/475*** | (2006.01) |
| ***B41J 2/01*** | (2006.01) |
| *B41J 2/44* | (2006.01) |

(52) U.S. Cl.
CPC ..... *B41J 11/002* (2013.01); *B41J 2/01* (2013.01); *B41J 2/475* (2013.01); *B41J 2/44* (2013.01)

(58) Field of Classification Search
CPC ... B41J 11/002; B41J 2/475; B41J 2/01; B41J 2/44
See application file for complete search history.

(56) References Cited

U.S. PATENT DOCUMENTS

| | | | |
|---|---|---|---|
| 2007/0070162 | A1 | 3/2007 | Yokoyama |
| 2008/0012919 | A1 | 1/2008 | Sugahara |
| 2013/0293609 | A1 | 11/2013 | Ohkawa |

FOREIGN PATENT DOCUMENTS

| | | | |
|---|---|---|---|
| DE | 10 2005 045 203 | A1 | 3/2007 |
| EP | 2 221 183 | A1 | 8/2010 |
| EP | 2 636 709 | A1 | 9/2013 |
| JP | 2007-276414 | A | 10/2007 |
| WO | 99/46546 | A1 | 9/1999 |

OTHER PUBLICATIONS

Official Communication issued in International Patent Application No. PCT/EP2015/051437, mailed on Apr. 22, 2015.

*Primary Examiner* — Henok Legesse
(74) *Attorney, Agent, or Firm* — Keating and Bennett, LLP

(57) ABSTRACT

A UV inkjet printer includes a UV radiation device to irradiate jetted ink on a receiver, wherein the UV radiation device is attached to an inkjet print head module and includes a UV bulb lamp parallel to a slow scan direction; and the radiation device includes a shutter system to create a first irradiation zone on the receiver and to create a second irradiation zone.

14 Claims, 8 Drawing Sheets

INKJET PRINTER WITH UV BULB SHUTTER SYSTEM INCLUDING MORE THAN ONE MOVABLE SHUTTER

CROSS-REFERENCE TO RELATED APPLICATIONS

This application is a 371 National Stage Application of PCT/EP2015/051437, filed Jan. 26, 2015. This application claims the benefit of European Application No. 14152614.5, filed Jan. 27, 2014, which is incorporated by reference herein in its entirety.

BACKGROUND OF THE INVENTION

1. Field of the Invention

The technical field of the invention relates to UV inkjet printers, such as wide-format UV inkjet printers, to overlay a jetted color or gray image with an ultraviolet curable varnish to achieve a glossy finish.

2. Description of the Related Art

In the related art, as a printing method for forming an image based on an image data signal on a receiver such as paper, various methods have been used. Among them, an inkjet printing method is used with an apparatus with a low cost which discharges ink only to a necessary image unit, such as an inkjet print head, and performs direct image formation on a receiver.

An inkjet printer stores the printing data electronically and controls a mechanism for ejecting the drops image-wise.

In recent years, in order to form an image having excellent water resistance, solvent resistance, rub fastness and the like on a surface of a receiver, an ink jet printing method using ultraviolet curable ink, also called UV inkjet ink, has been used wherein the UV inkjet ink is cured when being irradiated with ultraviolet light by an UV radiation device (100) has been used. The inkjet printing method using ultraviolet curable ink is also called UV inkjet printing method. The advantage of UV inkjet inks in an inkjet printing method is that they are immobilized on the receiver as soon as they are cured, they can be applied to a wide range of uncoated receivers, and they produce a very robust image.

More information about inkjet printing methods is disclosed in STEPHEN F. POND. Inkjet Technology and Product Development Strategies. USA: Torrey Pines Research, 2000.

Problems with gloss homogeneity in UV inkjet printers, especially wide-format UV inkjet printers, are observed. To solve these problems a varnish is applied on the jetted image. A varnish is a transparent liquid applied to a surface for producing a glossy appearance. A varnish may also be designed to produce satin or semi-gloss sheens by the addition of "flatting" agents. These flatting agents, also often called matting agents, are particulate substances for scattering incident light rays on the varnished surface. The varnish may be applied by an UV inkjet printing method using an ultraviolet curable varnish, also called an UV inkjet varnish. Another major advantage of using an UV inkjet printing method to apply a UV inkjet varnish is that it allows variable data printing or region-of-interest (ROI) varnishing on a receiver.

EP2221183 (MGI France) discloses a varnish printer with inkjet print heads.

US2007070162 (YOKOYAMA TAKESHI) discloses an shutter system for an inkjet printer wherein the controlling is adapted to control the dimension of the irradiation zone in the direction of scanning of the inkjet print head module (300), namely the fast-scan direction.

US2013293609 (OHKAWA MASAKATSU) discloses an UV radiation device which comprises UV LED's wherein the UV LED's are controlled to adapt the amount of irradiations.

US2008012919 (SUGUHARA HIROTO) discloses a method wherein two irradiation zones are created: one in the image formation area and one in the adhesion area.

In recent years, UV inkjet printers, such as wide-format printers, have the ability to jet colored UV inkjet inks, such as cyan, magenta, yellow, black and/or white on a receiver together with an UV inkjet varnish.

Typically applying a varnish requires for the UV inkjet varnish to be given enough time to flow (spread) across the receiver to create an even glossy surface finish before it is cured. Therefore in a typical UV inkjet method by applying an UV inkjet varnish on a color or gray image jetted on a receiver, the UV radiation device has to be offset in the slow scan direction in order to give it the extended time for the varnish to properly spread. Or the curing of the jetted UV inkjet varnish, which is not cured in the first passing of the receiver under the inkjet print head module, has to be applied in a second passing of the receiver under the inkjet print head module which is less economical due to a lower production time.

The offsetting and repositioning of the UV radiation device may cause problems such as curing the ink on the nozzle-plate of the inkjet print heads in the inkjet print head module while offsetting and failures in correct (re)positioning of the UV radiation device. The production and alignment of the means for offsetting the UV radiation device are also less economical due to the manufacturing time and manufacturing cost.

Therefore a solution is needed to lower the production time, manufacturing time and manufacturing cost and preventing occasional curing of ink on the outer surface and the inner surface of the nozzles of the inkjet print heads in the inkjet print head module.

To achieve a better print quality, time-to-cure of an UV inkjet ink may be controlled, which may be controlled by UV LEDs but the manufacturing costs and the cost of UV LEDs is economical a disadvantage. Therefore a solution is needed to control the time-to-cure with an economical advantage.

SUMMARY OF THE INVENTION

The invention permits to achieve the solution with the use of an UV bulb lamp in the UV radiation device (100) which does not have to be repositioned before applying of the UV inkjet varnish on a color or gray image that is jetted on a receiver.

A preferred embodiment of the UV inkjet printer comprises an UV radiation device (100) to irradiate jetted ink on a receiver, wherein the UV radiation device (100) is attached to the inkjet print head module (300) and comprising a shutter system (200); wherein the shutter system (200) is characterized by comprising a controlling means to switch from a first irradiation zone to a second irradiation zone.

Preferably the UV radiation device (100) comprises an UV bulb lamp. The use of UV bulb lamps is more manufacturing cost-effective than the use of UV LED lamps.

In a preferred embodiment of the UV inkjet printer the shutter system (200) may create more than two irradiation zones.

The first irradiation zone is preferably used to cure a jetted color or gray image on the receiver and the second irradiation zone is preferably used to cure a jetted varnish layer on the receiver and/or the color or gray image on the receiver.

The jetting and curing of a color or gray image on the receiver while passing the receiver under the inkjet print head module (300) is called the UV inkjet ink jetting-and-curing passing. The jetting and curing of the varnish layer on the receiver and/or on the jetted color or gray image on the receiver while passing the receiver under the inkjet print head module (300) is called the UV inkjet varnish jetting-and-curing passing.

The passing of the receiver under the inkjet print head module (300) may be in a preferred embodiment of the UV inkjet printer transiting of the receiver under the inkjet print head module (300) by a transport system such as a belt conveyor or flat table system. Preferably the transport system in a preferred embodiment of the UV inkjet printer is a belt step conveyor system or the passing of the receiver under the inkjet print head module (300) may be in a preferred embodiment of the UV inkjet printer moving the inkjet print head module (300) in slow scan direction (370) above the receiver or a combination of transiting of the receiver under the inkjet print head module (300) and moving the inkjet print head module (300) in slow scan direction (370).

An example of a belt conveyor belt system with an electric stepper motor is described for the media transport of a wide-format printer in EP 1235690 A (ENCAD INC).

To determine the optimal dimensions of one of the irradiation zones in a preferred embodiment of the UV inkjet printer, the UV inkjet printer preferably comprises a controlling means attached to the shutter system (200) to change the dimension of one of the irradiation zones in the slow scan direction (370) of the UV inkjet printer so the dimensions are determined to prevent accidental curing of ink or varnish on the outer surface or inner surface of a nozzle in an inkjet print head from the inkjet print head module (300) so no nozzles are blocked with cured ink. The changing of the dimension along slow-scan direction of one of the irradiation zones may also cause the time-to-cure and/or the amount of irradiation while passing the receiver.

In a preferred embodiment of the UV inkjet printer the UV inkjet ink printing zone of the UV inkjet printer doesn't overlap the second irradiation zone. It is observed that in the UV inkjet varnish jetting-and-curing passing that if there is an overlap of the UV inkjet ink printing zone and the second irradiation zone the extra curing on the jetted color or gray image in the UV inkjet varnish jetting-and-curing passing may cause image quality problems in this overlap such as gloss-differences or stripes in the top-layers of the jetted color or gray image or stripes in the top-layers of the varnished color or gray image.

In a preferred embodiment of the UV inkjet printer, the UV inkjet printer comprises:

- a cured ink droplet of an UV inkjet ink on the receiver, wherein
  - the ink droplet is jetted from a first inkjet print head in the inkjet print head module; and
  - the ink droplet is cured in the first irradiation zone; and
  - a cured varnish droplet of an UV inkjet varnish partially on top of the cured ink droplet, wherein
  - the varnish droplet is jetted from a second inkjet print head in the inkjet print head module (300); and
  - the varnish droplet is cured in the second irradiation zone.

A shutter system (200) in a preferred embodiment of the UV inkjet printer comprises a movable shutter means along the slow scan direction (370) wherein the position of the movable shutter means is determined to control the dimension in the slow scan direction (370) of an irradiation zone.

But to create both irradiation zones in a more preferred embodiment of the UV inkjet printer wherein the shutter system (200) comprises

- a second shutter means to create the second irradiation zone on the receiver when the second shutter is open; and
- a first shutter means to create together with the open second shutter means the first irradiation zone on the receiver when the first shutter is open.

The gap in the slow scan direction (370) between the two shutter means should be minimized. The final result of a preferred embodiment of the UV inkjet printer is effective if the gap between the two shutter means is less than 8 mm, more preferably less than 5 mm and most preferably less than 3 mm. This preferred embodiment also minimizes the stray-light of the UV radiation device (100).

A preferred embodiment of the UV inkjet printer with the first and second shutter means may comprising configuring means to change from a first printing configuration wherein the first shutter means and second shutter means of the UV radiation device (100) are open to a second printing configuration wherein the first shutter means of the UV radiation device (100) is closed and second shutter means of the UV radiation device (100) is open.

The first printing configuration is preferably used before starting the UV inkjet ink jetting-and-curing passing and the second printing configuration used before starting the UV inkjet varnish jetting-and-curing passing. The UV inkjet printing method, performed by a preferred embodiment of the UV inkjet printer, may be described as followed:

An UV inkjet printing method in an UV inkjet printer comprising the following steps:

- a) performing a first printing configuration by:
- a1) if a first shutter means of an UV radiation device (100) is closed, open the first shutter means of the UV radiation device (100); and
- a2) if a second shutter means of the UV radiation device (100) is closed, open the second shutter means of the UV radiation device (100); and
- a3) create a first irradiation zone by the open first shutter means and the open second shutter means on an receiver of the UV inkjet printer; and
- a4) jetting an UV inkjet ink on the receiver of the UV inkjet printer; and
- a5) irradiating the jetted UV inkjet ink in the first irradiation zone; and
- b) performing a second printing configuration by:
- b1) closing the first shutter means of the UV radiation device (100); and
- b2) create a second irradiation zone by the closed first shutter means and open second shutter means on an receiver of the UV inkjet printer; and
- b3) jetting an UV inkjet varnish on the receiver of the UV inkjet printer; and
- b4) irradiating the jetted UV inkjet varnish in the second irradiation zone.

In a preferred embodiment of the UV inkjet printer, the UV inkjet printer comprises configuring means to rotate the UV radiation device (100) around an axis parallel with the slow scan direction (370) and wherein the rotation angle is smaller or equal than 45 degrees away from the inkjet print heads in the inkjet print head module (300). Preferably these configuring means are used to rotate the UV radiation device (100) around an axis parallel with the slow scan direction (370) and wherein the rotation angle is smaller or equal than 45 degrees away from the inkjet print heads in the inkjet print head module (300) while changing to the second printing configuration and these configuring means are used to rotate back while changing to the first printing configuration. The rotation angle may be smaller or equal than 30 degrees and preferably be smaller or equal than 15 degrees. The rotation of the UV radiation device (100) causes a defocusing of the UV light on the receiver which gives a benefit in the spread of the ink and varnish as a controller of the time-to-cure. Especially when the rotation of the UV radiation device (100) is done at the change to the second print configuration the varnish may spread more which results in an optimal glossy effect of the printed image.

To simplify the shutter system (200) in a preferred embodiment of the UV inkjet printer with the first and second shutter means, one of the shutter means in the UV radiation device (100) may be coupled to driving means to open and close the shutter means and another shutter means of the shutter means in the UV radiation device (100) comprises engaging means to engage on the driving means to open and close the other shutter means simultaneously with the shutter means and to disengage from the driving means to remain the another shutter means closed. This simplification decreases the manufacturing cost because only one driving means has to be used.

A shutter means in a preferred embodiment of the UV inkjet printer may comprise one or more shutter blades.

The UV radiation device (100) in a preferred embodiment of the UV inkjet printer with the first and second shutter means comprises preferably pivotal means in the first and/or second shutter means to rotate a shutter blade around an axis parallel to the slow scan direction (370) of the UV inkjet printer, Such as rotating around a shaft parallel to the slow scan direction (370). This shaft may be connected to the engaging means to engage or disengage the shutter means as in a previous preferred embodiment to simplify the shutter system (200). The UV radiation device (100) in a preferred embodiment of the UV inkjet printer with the first and second shutter means comprises for each shutter means a drive system separately driven top open and close the shutter means.

The UV radiation device (100) in a preferred embodiment of the UV inkjet printer with the first and second shutter means comprises a temperature controller that controls the temperature of the shutter means differently or controls the temperature of one or more shutter blades of each shutter means differently. The temperature controlling may be achieved by passing cooling water through the shutter means or through one or more shutter blades because the shutter means can become extremely hot and they are preferably cooled. The temperature controlling may also be achieved by forced air flow around the shutter blades because the shutters means can become extremely hot and they are preferably cooled.

In a preferred embodiment of the UV inkjet printer the dimension of the UV inkjet ink printing zone along the slow scan direction (370) is smaller or equal than the dimension of the first irradiation zone along the slow scan direction (370) and the first irradiation zone overlaps in slow scan direction (370) the UV inkjet ink printing zone.

At the start of the performance of the second printing configuration, the UV inkjet printing method comprises a step of wiping the receiver with a fluid selected from ethanol, isopropanol, methanol, acetone or alcohol to clean the receiver to obtain a uniform glossy effect.

BRIEF DESCRIPTION OF THE DRAWINGS

FIG. 5, FIG. 8, FIG. 11 and FIG. 14 illustrate a configuration of the UV inkjet printer during a standby-mode or power-off of the UV inkjet printer. In these configurations of the UV inkjet printer there is no irradiation zone.

FIG. 6, FIG. 9, FIG. 12 and FIG. 15 illustrate a printing configuration of the UV inkjet printer during the ink jetting-and-curing passage of a preferred embodiment. In these configuration of the UV inkjet printer the irradiation zone (400) irradiates the receiver in line with the print zone of the inkjet print head module (300).

FIG. 7, FIG. 10, FIG. 13 and FIG. 16 illustrate a printing configuration during the varnish jetting-and-curing passage. In these configuration of the UV inkjet printer the irradiation zone (400) irradiates the receiver in line with the print zone of the inkjet print head module (300).

In FIG. 5, FIG. 6, FIG. 7, FIG. 8, FIG. 9, FIG. 10, FIG. 11, FIG. 12, FIG. 13, FIG. 14, FIG. 15 and FIG. 16 the dimension in slow scan direction (370) of the print zone is equal to the dimension in slow scan direction (370) of the ink print zone (311). The dimension in slow scan direction (370) of the varnish print zone (312) is in both printing configuration smaller due to less inkjet print heads that are jetting the UV inkjet varnish.

DETAILED DESCRIPTION OF A PREFERRED EMBODIMENTS

Definitions

Inkjet UV Printer

Figure 1:
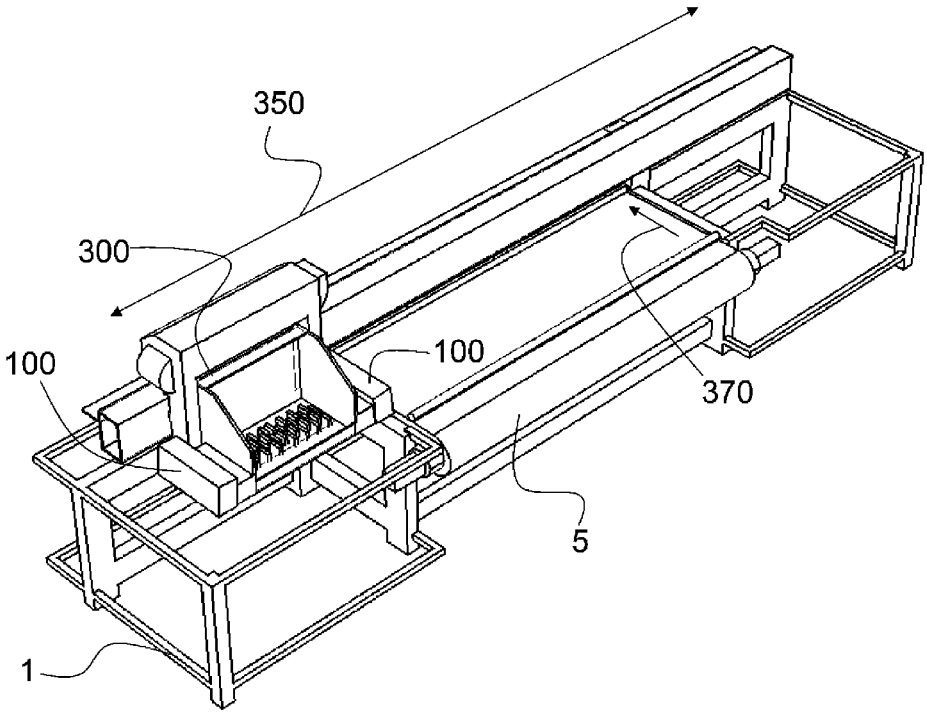
FIG. 1 illustrates a wide-format UV inkjet printer (1) as a preferred embodiment of the UV inkjet printer which comprises a movable inkjet print head module (300) with a plurality of UV inkjet print heads. At both sides of the movable inkjet print head module (300) an UV radiation device (100) is attached (100). The direction wherein the inkjet print head module (300) is moving (forth and back) is the fast scan direction (350). The direction wherein a receiver is moving on the conveyor belt (5) underneath the inkjet print head module (300) is the slow scan direction (370).
Figure 2:
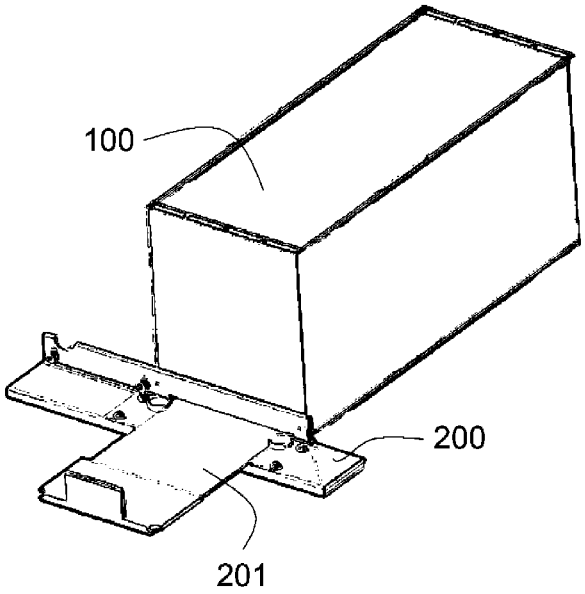
FIG. 2 illustrates an UV radiation device (100) which may be part of a preferred embodiment of the UV inkjet printer. The UV radiation device (100) comprises a shutter system (200) wherein a movable shutter means (201) is sliding under the UV radiation device (100) to change the irradiation zone from the UV radiation device (100).
Figure 3:
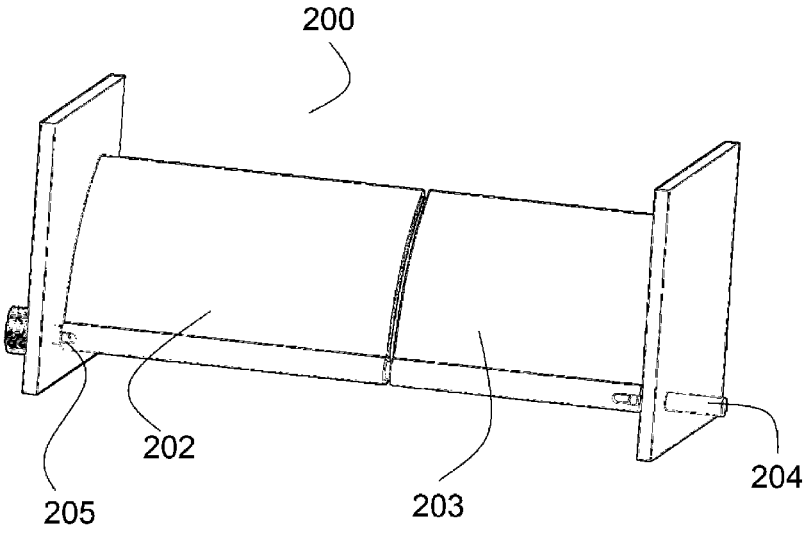
FIG. 3 and FIG. 4 illustrate a shutter system (200) which may be part of a preferred embodiment of the UV inkjet printer. The shutter system (200) is attached, underneath, at the bottom of an UV radiation device (100) (which is not visible). The shutter system (200) comprises 2 shutter means (202, 203), each with one shutter blade. The shutter system (200) comprises a pivotal means (204) to rotate the shutter blades around an axis to open and/close a shutter (202, 203). Both figures are also illustrating an engaging means (205) wherein a shutter means may engage (FIG. 3) or disengage (FIG. 4) from the pivotal means (204).
Figure 4:
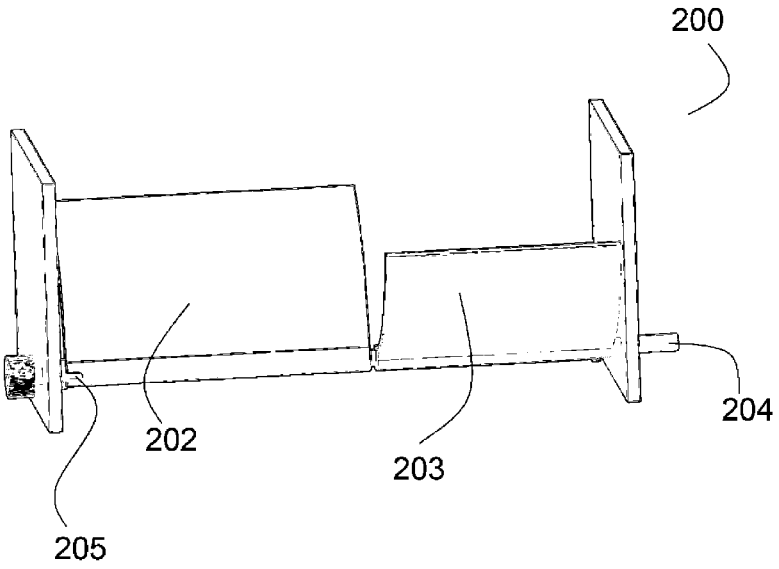

An inkjet UV printer is a dot matrix printer that is using an inkjet printing head which jets ultraviolet curable liquid such as a UV inkjet ink, UV inkjet varnish on a receiver such as paper or plastic. To cure an ultraviolet curable liquid the inkjet UV printer comprises an UV radiation device (100).

The printing may be monochrome, e.g. black for gray images, or multi-colored, e.g. full color printing using a CMY (cyan, magenta, yellow, black=a process black made up of a combination of C, M, Y), a CMYK (cyan, magenta, yellow, black), or a specialized color scheme, (e.g. CMYK plus one or more additional spot or specialized colors). To print a receiver such as paper or plastic, the nozzles of inkjet print heads are used or "fired" in a specific order while the receiver is moved relative to the inkjet printing heads in an inkjet print head module (300). Each time a nozzle is fired, a liquid is transferred to the receiver.

Typically, in one form of inkjet UV printer, the inkjet head module, which comprises an inkjet print head, will be moved relative to the receiver to produce a so-called raster line which extends in a first direction, e.g. across the receiver. The first direction is sometimes called the fast scan direction. A raster line comprises a series of jetted droplets delivered onto the receiver by the nozzles of the inkjet printing head. The receiver is moved, usually intermittently, in a second direction perpendicular to the first direction. The second direction is often called the slow scan direction (370).

More information about slow scan direction (370) and fast scan direction of a printer is disclosed in EP1930169 (AGFA GRAPHICS) wherein a curing method for an UV inkjet printer is invented.

Wide-Format UV Inkjet Printer

Wide-format UV inkjet printers are generally accepted to be UV inkjet printers with a print width over 17". Wide-format UV inkjet printers with a print width over the 100" are also super-wide-format UV inkjet printers or grand format UV inkjet printers. Wide-format UV inkjet printers are mostly used to print banners, posters, textiles and general signage and in some cases may be more economical than short-run methods such as screen printing. Wide format printers generally use a roll of substrate rather than individual sheets of substrate but today also wide format printers exist with a table whereon substrate is loaded. Either the table moves under an inkjet print head module (300) or a gantry moves an inkjet print head module (300) over the table. These so called flat-table UV inkjet printers most often are used for the printing of planar substrates or ridged substrates or sheets of flexible substrates.

In a preferred embodiment the UV inkjet printer is a wide-format UV inkjet printer and in a more preferred embodiment the UV inkjet printer is a super-wide-format UV inkjet printer.

In a preferred embodiment the UV inkjet printer is a flat-table UV inkjet printer, in a more preferred embodiment the UV inkjet printer comprises a conveyor belt to carry the receiver.

In a preferred embodiment the UV inkjet printer the lay-down of the UV inkjet ink in the UV inkjet ink jetting-and-curing passing is different than the lay-down of the UV inkjet varnish in the UV inkjet varnish jetting-and-curing passing. A lay-down of a liquid in an inkjet printer on a receiver may be shingling whether or not combined with interlacing or a lay-down of a liquid in an inkjet printer on a receiver may be using a print mask.

An example of a lay-down by a print mask is disclosed in U.S. Pat. No. 5,992,962 (Hewlett-Packard Company) and an example of a lay-down by shingling-and-interlacing is disclosed in U.S. Pat. No. 8,018,634 (Agfa Graphics) wherein printing mutually interstitial images (=shingling-and-interlacing) solves ink coalescence in inkjet printing.

Inkjet Print Head Module (300)

The inkjet print head module (300) comprises one or more inkjet print heads to jet an UV inkjet ink and one or more inkjet print heads to jet a UV varnish inkjet ink. The nozzle rows of the inkjet print heads in the inkjet print head module (300) are preferably parallel with each other and more preferably also parallel with the slow scan direction (370). The nozzle rows of one or more inkjet print heads that jets the same liquid in the inkjet print head module (300) and the nozzle rows of these inkjet print heads are aligned to each other is called a nozzle row column. In a preferred embodiment a nozzle row column in an inkjet print head is parallel to the slow scan direction (370) of the UV inkjet printer wherein its comprised.

An inkjet print head module (300) may comprise one or more nozzle row columns for the same inkjet UV ink or for the UV varnish.

The inkjet print head module (300) may comprise a nozzle row column for a cyan (C), for magenta (M), for yellow (Y) and for black (K) UV inkjet ink and for an UV inkjet varnish (U).

The inkjet printer head module may comprise a nozzle row column for a white UV inkjet ink (W).

The inkjet printer head module may comprise a base plate whereon the inkjet print heads are attached. The inkjet printer head module may comprise alignment means to control the position of the inkjet print heads. EP1805020 (XAAR) discloses, as example for alignment means, a method of aligning print modules, printers and print heads. The modules and chassis are formed with a number of alignment features which engage with one another to form elastic interference couplings, thus enabling highly repeatable alignment between components.

The inkjet printer head module may comprise a set of nozzle row columns for an ordered set of liquids that is mirrored around the slow scan direction (370) from another set of nozzle row columns of an ordered set of the same liquids. Preferably the ordered set of liquids is an ordered set of UV inkjet inks.

Print Zone

The print zone of the inkjet print head module (300) is a logical zone that defines the area on a receiver that is printed by an inkjet print head module (300) wherein all nozzles are activated in an UV inkjet printer while the inkjet print head module (300) is moved in the fast scan direction above the receiver.

The UV inkjet ink print zone of the inkjet print head module (300) is a logical zone that defines the area on a receiver that is printed by an inkjet print head module (300) wherein all nozzles are activated from inkjet print heads which jets an UV inkjet ink while the inkjet print head module (300) is moved in the fast scan direction above the receiver.

The UV inkjet varnish print zone of the inkjet print head module (300) is a logical zone that defines the area on a receiver that is printed by an inkjet print head module (300) wherein all nozzles are activated from inkjet print heads which jets an UV inkjet varnish while the inkjet print head module (300) is moved in the fast scan direction above the receiver.

UV Radiation Device (100)

The UV radiation device (100) is a device for irradiation of a receiver by electromagnetic radiation wherein the electromagnetic radiation is UV radiation. The UV radiation device (100) comprises a housing having an oriented opening in the direction of a UV inkjet ink, UV varnish which is jetted on a receiver. The housing comprises an elongate radiation house such as UV bulb lamp. Preferably the length of the UV bulb lamp, in a preferred embodiment of the UV inkjet printer, is parallel with the slow scan direction (370). The UV bulb lamp consists essentially of a tubular glass body, two electrodes and two pedestals. It may be partially surrounded by a reflector. An example of UV radiation device (100) is disclosed in EP1062467 (BISGES MICHAEL). Another example of UV radiation device (100) which is modular and comprises a removable holder with a barrier is disclosed in DE102005045203 (HOENLE AG DR).

The UV radiation device (100) may comprise:

- plug-in modules for easy handling and UV bulb lamp changing; and/or
- air cooled circulation and/or water cooled circulation to optimize the heat extraction inside the housing; and/or
- a monitoring system for safety requirements; and/or
- a control unit with graphical display and/or touch panel for easy operating.

The shutter system (200) in a preferred embodiment of the UV inkjet printer may comprise shutter means as a means of quickly eliminating UV exposure without shutting off the UV bulb lamp, permitting rapid restart of the irradiation towards the ink layers or varnish layers. Without such shutter means, most UV radiation devices (100) would need to be powered off, requiring a lengthy cool down and restart procedure, which wastes significant amounts of production time in a day. Such shutter means may comprise reflector geometries to optimize the heat extraction inside the housing.

A shutter means in a shutter system (200) may comprise one or more shutter blades. A shutter means may comprise actuator means to move the shutter blades such as mechanical actuators, hydraulic actuators, pneumatic actuators or piezoelectric actuators or any moving system known by the state-of-the-art.

Figure 5:
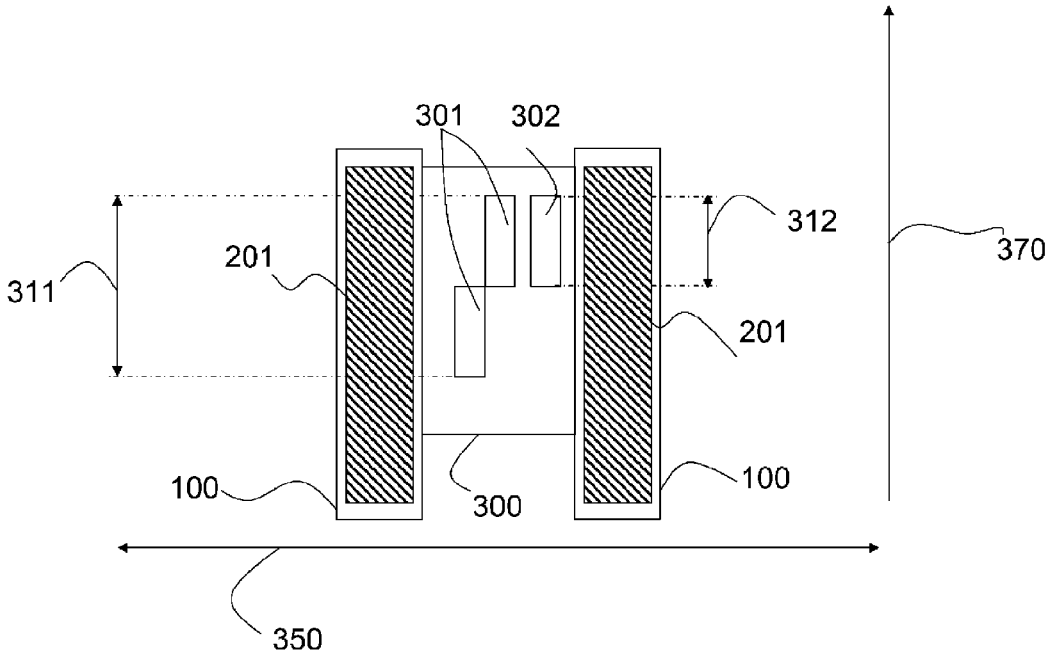
FIG. 5, FIG. 6 and FIG. 7 illustrate the bottom view of inkjet head module which may be part of a preferred embodiment of the UV inkjet printer. The inkjet print head module (300) is moving above a receiver in a fast scan direction (350) and the inkjet print head module (300) is relative moved to a receiver on the UV inkjet printer in slow scan direction (370). Two UV radiation devices (100) are attached to the inkjet print head module (300) to move along with the inkjet head module (300) and to cure the droplets of the liquids from the inkjet print heads (301, 302) in the inkjet print head module (300). The inkjet print head module (300) comprises two inkjet print heads (301) to jet an UV inkjet ink and one inkjet print head (302) to jet an UV inkjet varnish. The two UV radiation devices (100) comprise each an shutter system (200) (which is not visible) wherein a shutter means (201) may slide in the slow scan direction (370) under the UV radiation device (100) to change the irradiation zone by an UV bulb lamp (101) inside the UV radiation device (100) (see also FIG. 2). The UV lamps (101) are not visible in FIG. 5 because the total closing of the shutter means (201). The irradiation zone (400) in the printing configuration of FIG. 7 shall have a smaller dimension in the slow scan direction (370) than the irradiation zone (400) in the configuration of FIG. 6.
Figure 6:
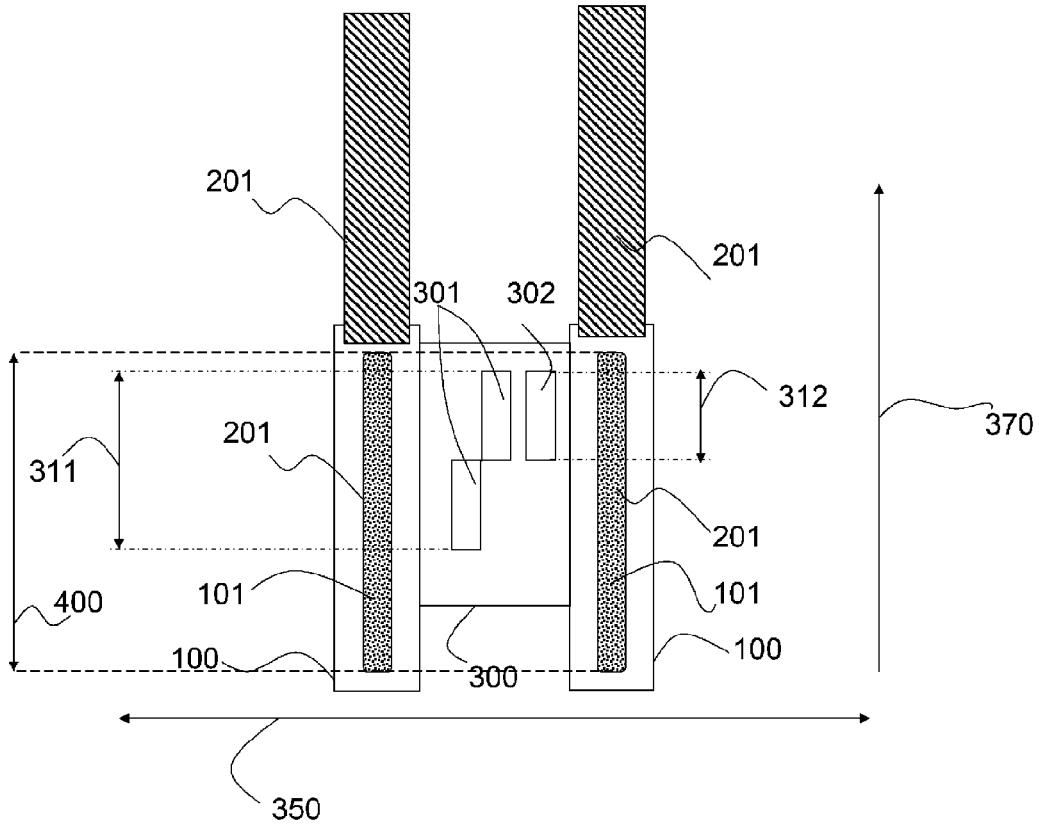
Figure 7:
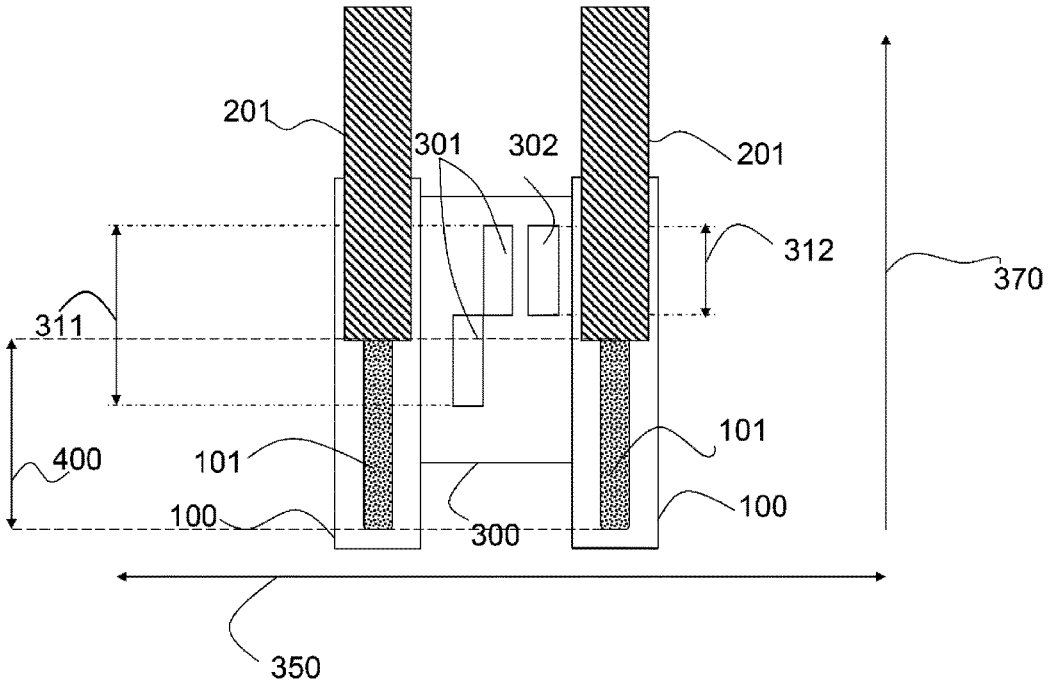
Figure 8:
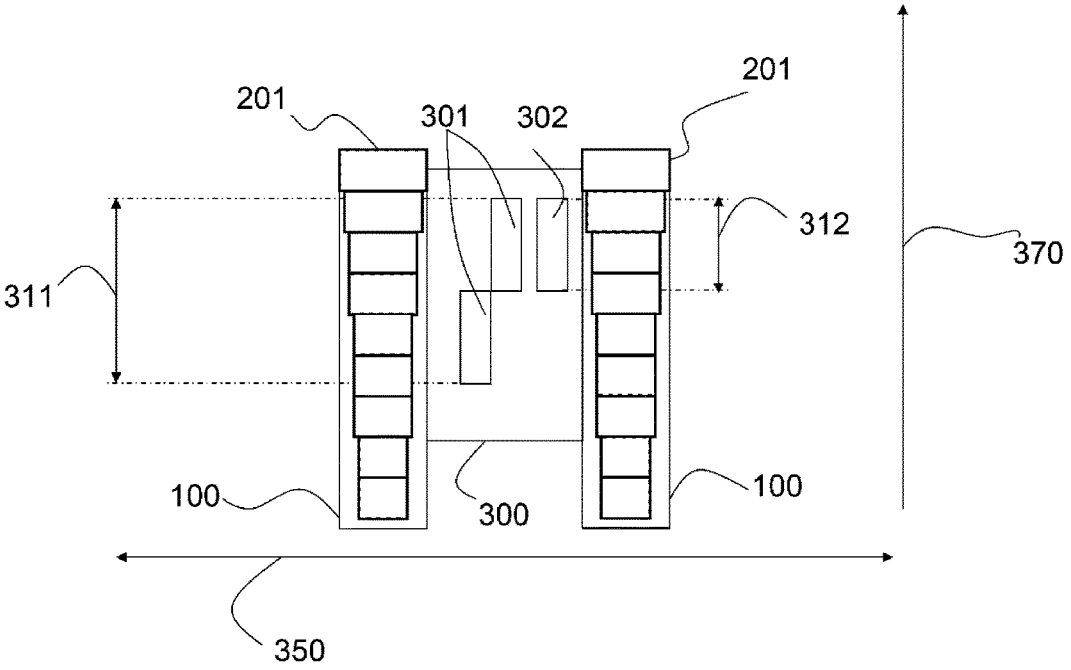
FIG. 8, FIG. 9 and FIG. 10 illustrate the bottom view of inkjet head module which may be part of a preferred embodiment of the UV inkjet printer. The means are the same as in the previous 3 figures only both shutter means (201) are different. The shutter means (201) may telescopic slide in the slow scan direction (370) under the UV radiation device (100) to change the irradiation zone by an UV bulb lamp (101) inside the UV radiation device (100). The UV lamps (101) are not visible in FIG. 8 because the total closing of the shutter means (201). The irradiation zone (400) in the printing configuration of FIG. 10 shall have a smaller dimension in the slow scan direction (370) than the irradiation zone (400) in the configuration of FIG. 9.
Figure 9:
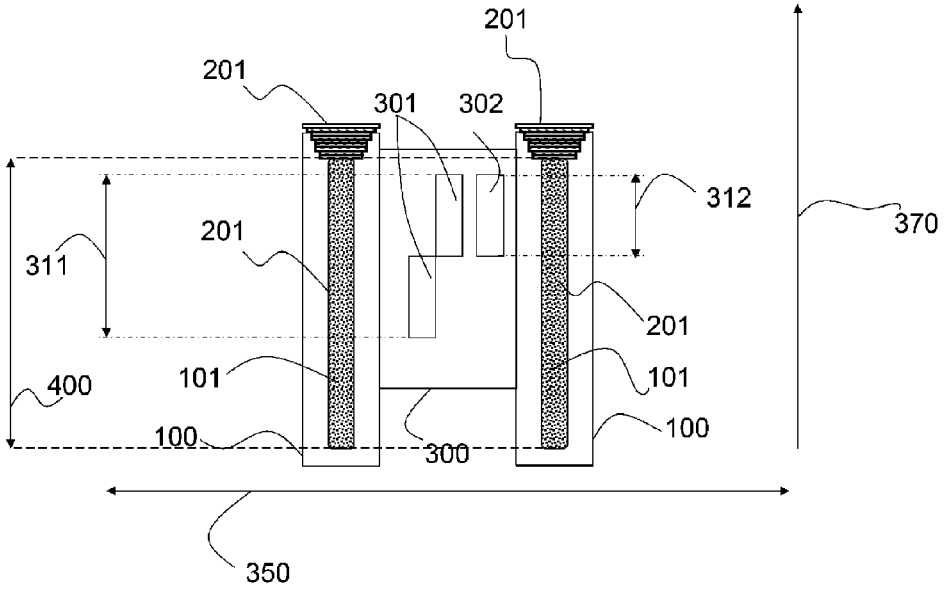
Figure 10:
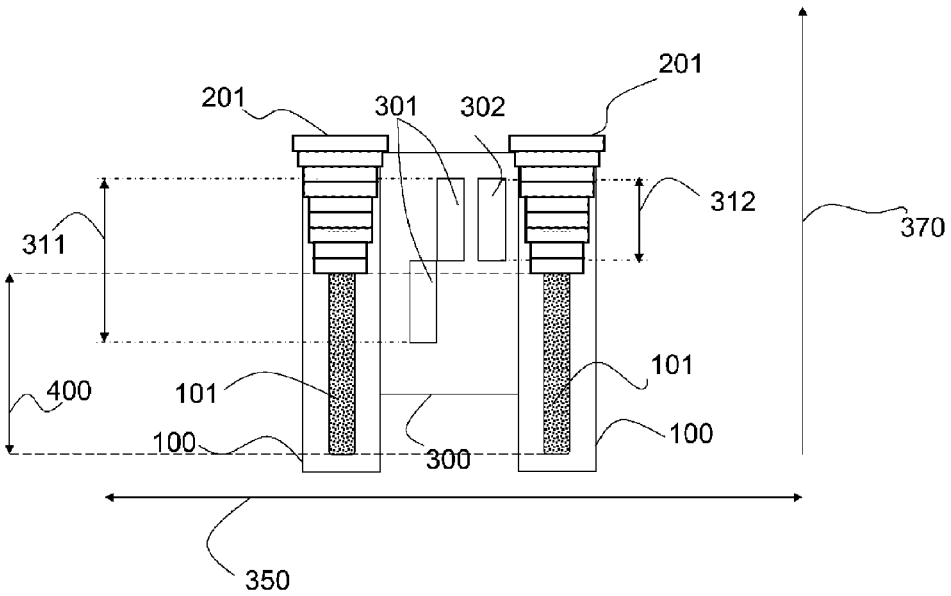
Figure 11:
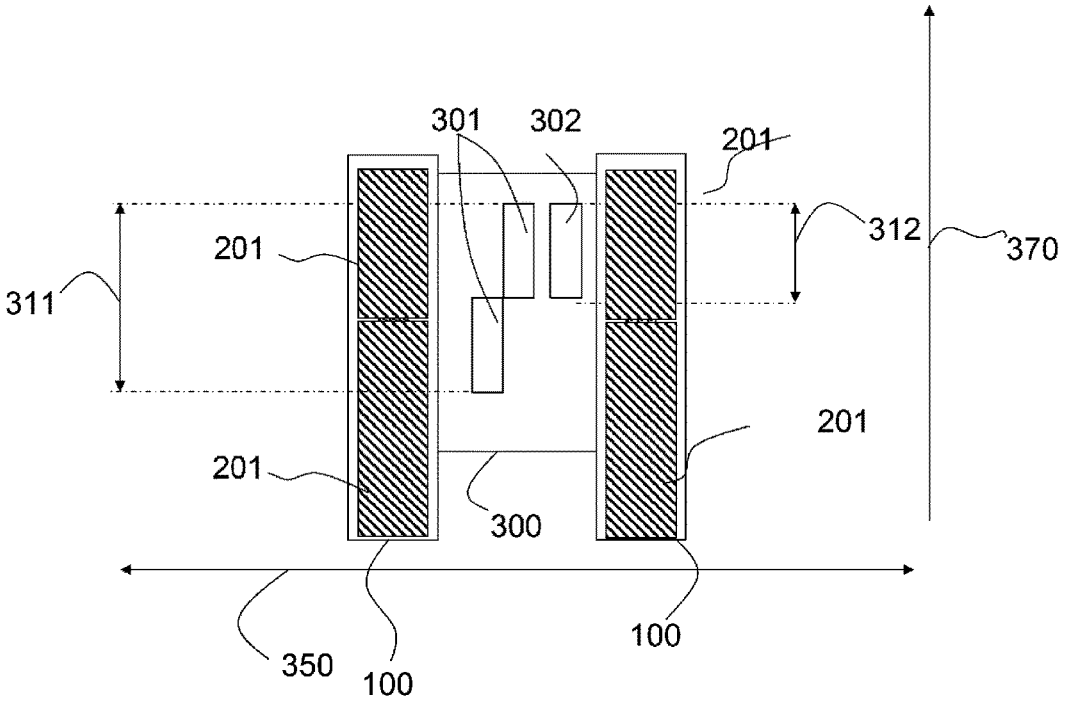
FIG. 11, FIG. 12 and FIG. 13 illustrate the bottom view of inkjet head module which may be part of a preferred embodiment of the UV inkjet printer. The means are the same as in the previous 3 figures only the amount and type of shutter means (201) are different. The four shutter means (201) may slide in the fast scan direction under the UV radiation device (100) to change the irradiation zone by an UV bulb lamp (101) inside the UV radiation device (100). The UV lamps (101) are not visible in FIG. 11 because the total closing of the shutter means (201). The irradiation zone in the printing configuration of FIG. 13 shall have a smaller dimension in the slow scan direction (370) than the irradiation zone in the configuration of FIG. 12.
Figure 12:
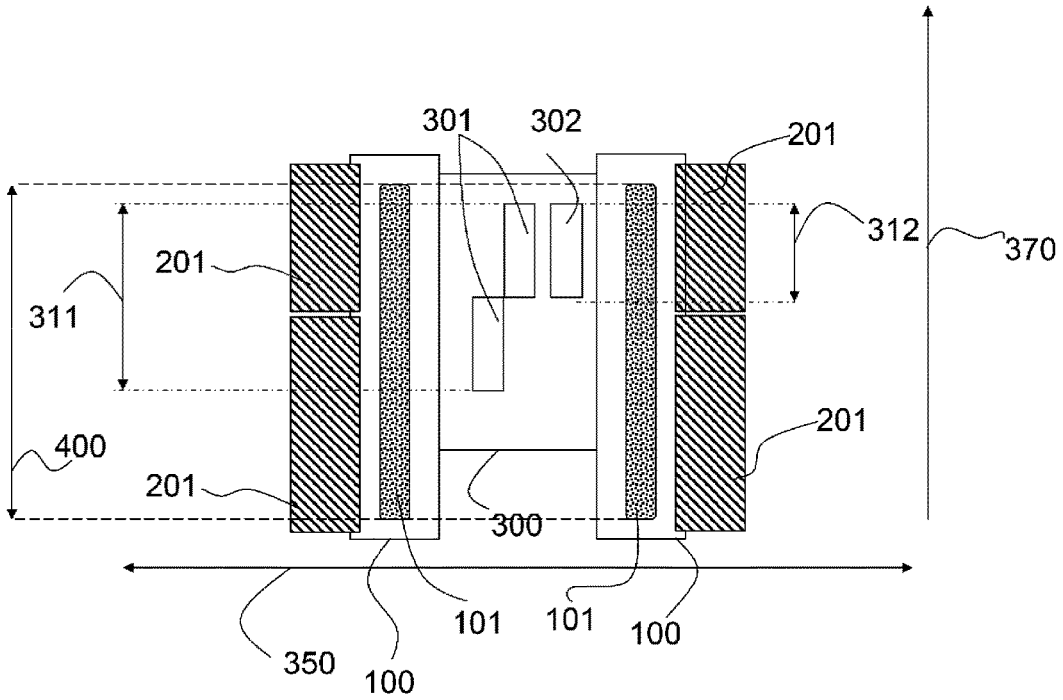
Figure 13:
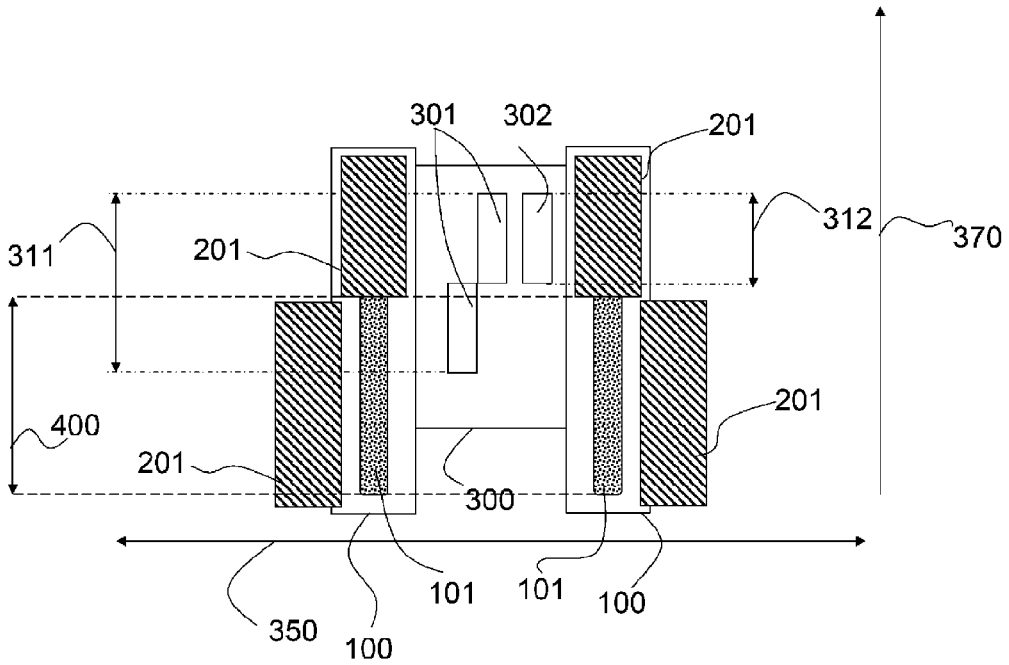
Figure 14:
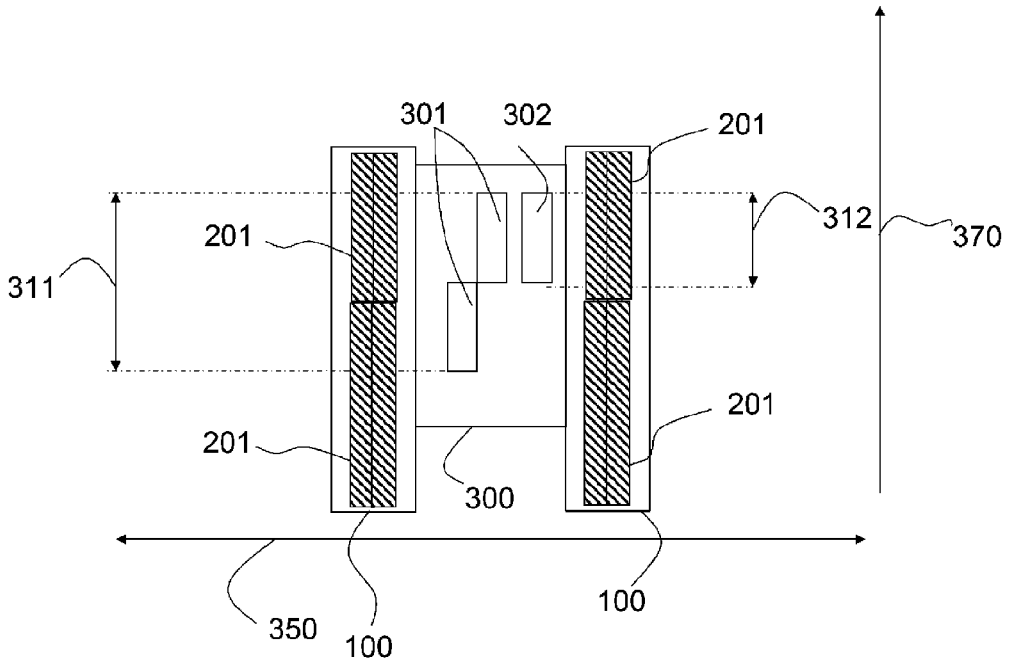
FIG. 14, FIG. 15 and FIG. 16 illustrate the bottom view of inkjet head module which may be part of a preferred embodiment of the UV inkjet printer. The means are the same as in the previous 3 figures only the type of the shutter means (201) are different. The shutter means (201) may slide two shutter blades in the fast scan direction under the UV radiation device (100) to change the irradiation zone by an UV bulb lamp (101) inside the UV radiation device (100). The UV lamps (101) are not visible in FIG. 14 because the total closing of the shutter means (201). The irradiation zone (400) in the printing configuration of FIG. 16 shall have a smaller dimension in the slow scan direction (370) than the irradiation zone (400) in the configuration of FIG. 15.
Figure 15:
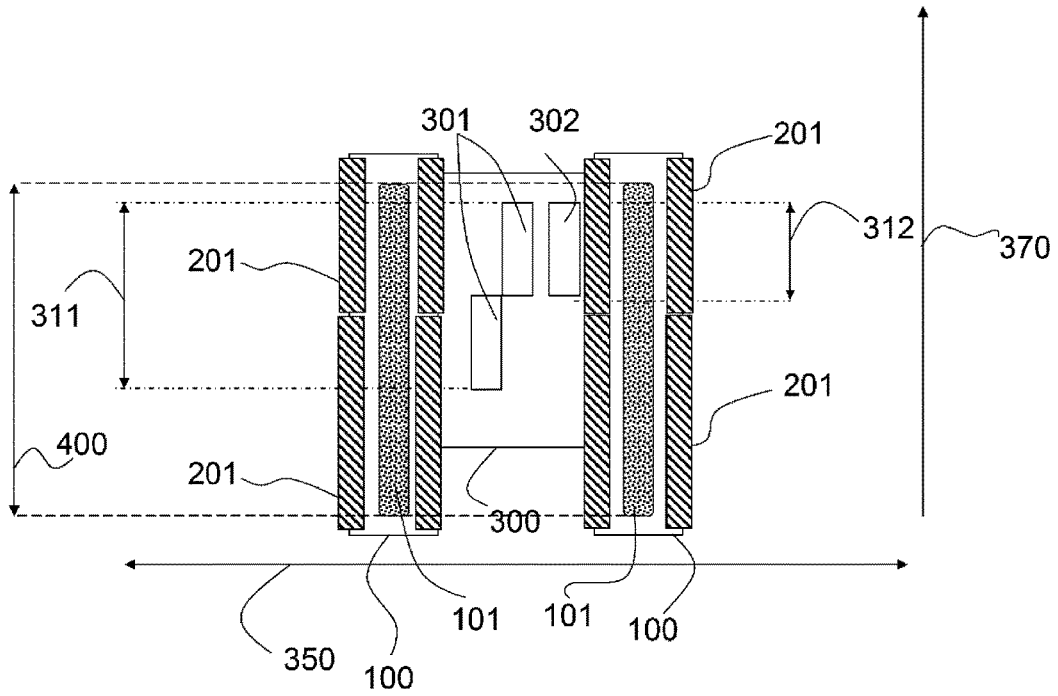
Figure 16:
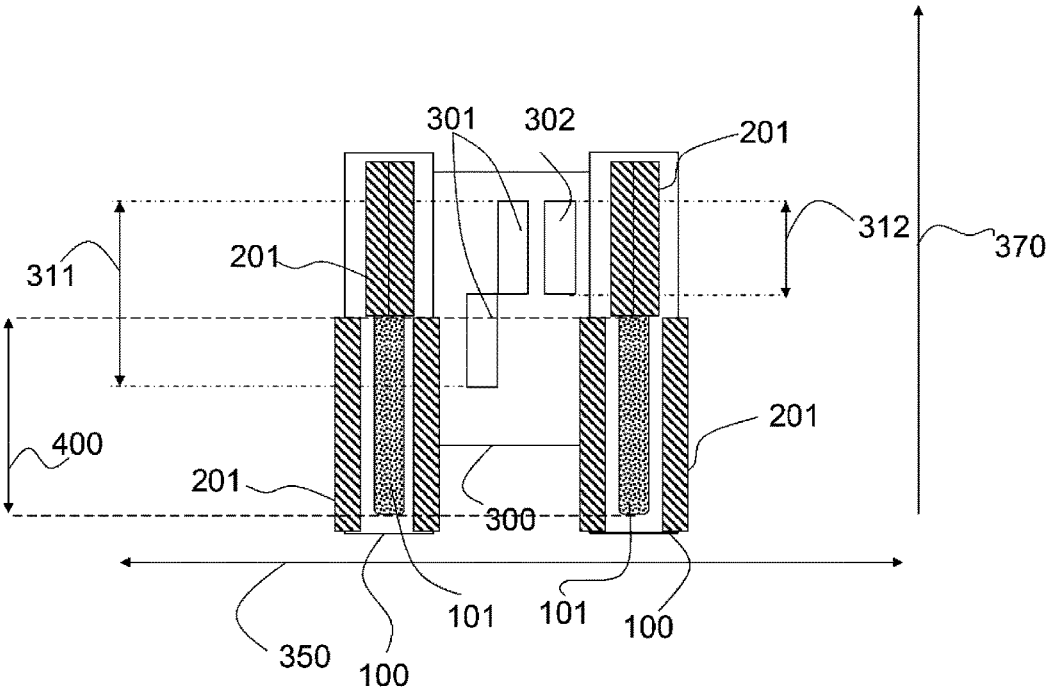

The figures according to FIG. 5 to FIG. 16 illustrate several shutter systems (200). A shutter means in the shutter system (200) attached to the UV radiation device (100) may comprise a shutter blade that slide in slow scan direction (370) to change the dimension of the irradiation zone in slow scan direction (370). A more preferred embodiment of the UV inkjet printer comprises a shutter system (200) attached to the UV radiation device (100) wherein the shutter blade is a telescopic blade that shrinks in slow scan direction (370) to change the dimension of the irradiation zone.

In a most preferred embodiment of the UV inkjet printer, the shutter system (200) attached to the UV radiation device (100) may comprise more than one shutter means, positioned in a row parallel with the slow scan direction (370), wherein one or more shutter blades moves in fast scan direction to change the dimension of the irradiation zone in slow scan direction (370).

The UV inkjet printer may combine the previous described types of shutter means to change the dimension of the irradiation zone in slow scan direction (370).

The UV radiation device (100) which is attached to the inkjet print head module (300) in a preferred embodiment of the UV inkjet printer may be rotated around an axis parallel with the slow scan direction (370) and wherein the rotation angle is smaller or equal than 45 degrees away from the inkjet print heads in the inkjet print head module (300) so the irradiation on the receiver is defocused which influences the time-to-cure. The rotation of the UV radiation device (100) has another benefit because the UV radiation device (100) is than it-self a light trap for the inkjet print heads in the inkjet print head module (300).

In the UV inkjet printer one or more UV radiation devices (100) may be attached to the inkjet print head module (300) so the UV bulb lamps in the housings of the UV radiation devices (100) are parallel to the slow scan direction (370).

Irradiation Zone

The irradiation zone is a logical zone that defines the area on a receiver that is irradiated by an UV radiation device (100) in an UV inkjet printer while the inkjet print head module (300) is moved in the fast scan direction.

Receiver

Preferably the receiver in a preferred embodiment is a flat workpiece and more preferably flexible sheets (e.g. paper, transparency foils, adhesive PVC sheets or ink-receivers) with thickness down to 100 micrometers and preferably down to 50 micrometers. Most preferably rigid sheets (e.g. hard board, PVC, carton, wood or ink-receivers) are used preferably with a thickness up to 2 centimeters and more preferably up to 5 centimeters. More preferably the receiver is flexible web material (e.g. paper, adhesive vinyl, fabrics and PVC, textile) as in a so called "roll-to-roll" configuration wherein the flexible web material is carried from roll to roll e.g. via a conveyor belt or "roll-to-sheet" configuration wherein the flexible web material is carried from roll e.g. via a conveyor belt to sheet after cutting the web material.

UV Inkjet Varnish

An UV inkjet varnish is preferably a colorless, clear radiation curable liquid, more preferably a free radical curable liquid. The addition of large size particulate matter, like a flatting or matting agent, to varnish generally leads to a translucent or even opaque cured layer in stead of the desired transparent layer. A transparent cured varnish layer allows good viewing or inspection of e.g. a print beneath the varnish layer.

In a preferred embodiment, the UV inkjet varnish contains no or less than 0.1 wt % of particulate matter based on the total weight of the UV inkjet varnish that has an average size larger than 10% of the nozzle diameter as measured by laser diffraction. In a more preferred embodiment, the UV inkjet varnish contains no particulate matter based on the total weight of the varnish that has an average size larger than 10% of the nozzle diameter as measured by laser diffraction. In a very preferred embodiment, the varnish contains no particulate matter at all.

The particulate matter can have different shapes, such as a globular or a needle shape. While particulate matter having a needle shape and a size equal or larger to the nozzle diameter may still glide through the nozzle and allow the full functioning of an inkjet print head, globular particulate matter having a diameter equal or larger to the nozzle diameter will block a nozzle in an inkjet print head from firing. Such a failing nozzle leads to undesired gloss differences and image artefacts. Hence, the varnish preferably includes no particulate matter having a size larger than the nozzle diameter of the one or more inkjet print heads, more preferably the varnish includes no particulate matter having a size larger than 70% of the nozzle diameter of the one or more inkjet print heads, and most preferably the varnish includes no particulate matter having a size larger than 50% of the nozzle diameter of the one or more inkjet print heads.

In another preferred embodiment, the UV inkjet varnish may include particulate matter of small size. A yellowish varnish or a varnish which turns yellow on radiation curing can be advantageously used to give a substrate, such as a print, an antique look. An antique look is commercially desirable e.g. for giving a piece of furniture an antique look or for making a photograph or a print look aged.

In one preferred embodiment, the varnish includes a yellow color pigment having an average particle size of less than 200 nm as determined by laser diffraction. Such small average particle size not only allows for printing with print heads having nozzle diameters of 30 μm or less, but also for keeping the varnish transparent so that colors below the varnish can still be clearly seen. If a yellow color pigment is used in the varnish, a polymeric dispersant similar to those disclosed for the radiation curable inkjet inks here below is preferably used. Suitable yellow pigments include those disclosed below for the radiation curable inkjet inks.

In another preferred embodiment, the varnish includes a photoyellowing photoinitiator, preferably a thioxanthone photoinitiator. Such a photoinitiator generally has a strong photoyellowing effect but also allows for fast curing within 500 milliseconds by an UV radiation device (100).

In yet another preferred embodiment, a combination of both a photoyellowing photoinitiator and a yellow color pigment having an average particle size of less than 200 nm as determined by laser diffraction may be sued.

The static surface tension of the UV inkjet varnish is preferably from 20 to 40 mN/m, more preferably from 22 to 35 mN/m. It is preferably not more than 40 mN/m from the viewpoint of the wettability. The static surface tension is preferably measured with a KRÜSS tensiometer K9 from KRÜSS GmbH, Germany at 25° C. after 60 seconds.

The UV inkjet varnish preferably also contains at least one surfactant so that the dynamic surface tension is no more than 30 mN/m measured by maximum bubble pressure tensiometry at a surface age of 50 ms and at 25° C. The dynamic surface tension is measured using a Bubble Pressure Tensiometer BP2 available from KRÜSS. The UV inkjet varnish is placed in a thermostatic vessel of the tensiometer at a temperature of 25° C. A silanized, glass capillary with a capillary radius 0.22 mm was immersed to a depth of 10 mm in the varnish. The dynamic surface tension is measured as a function of surface age using e.g. Labdesk software and using air as the gas for creating the bubbles.

In a preferred embodiment, the dynamic surface tension of the ink is less than or equal to the dynamic surface tension of the varnish.

For having a good ejecting ability and fast inkjet printing, the viscosity of the varnish at the temperature of 45° C. is preferably smaller than 30 mPa·s, more preferably smaller than 15 mPa·s, and most preferably between 1 and 10 mPa·s all at a shear rate of 30 $s^{-1}$. A preferred jetting temperature is between 10 and 70° C., more preferably between 25 and 50° C., and most preferably between 35 and 45° C.

The varnish may include the same ingredients as those disclosed for the radiation curable inkjet inks here below. Although, with the exception of a yellowish varnish, the varnish preferably does not include a colorant.

UV Inkjet Inks

The UV inkjet inks used in a preferred embodiment of the method of the present invention are preferably radiation curable inkjet inks, more preferably free radical curable inkjet inks.

The static surface tension of the UV inkjet ink is preferably from 20 to 40 mN/m, more preferably from 22 to 35 mN/m. It is preferably 20 mN/m or more from the viewpoint of printability by a second radiation curable inkjet ink, and it is preferably not more than 30 mN/m from the viewpoint of the wettability.

The inkjet ink preferably also contains at least one surfactant so that the dynamic surface tension is no more than 30 mN/m measured by maximum bubble pressure tensiometry at a surface age of 50 ms and at 25° C.

For having a good ejecting ability and fast inkjet printing, the viscosity of the inkjet ink at the temperature of 45° C. is preferably smaller than 30 mPa·s, more preferably smaller than 15 mPa·s, and most preferably between 1 and 10 mPa·s all at a shear rate of 30 $s^{-1}$. A preferred jetting temperature is between 10 and 70° C., more preferably between 25 and 50° C., and most preferably between 35 and 45° C.

A free radical UV curable inkjet ink may include any desired colorant, which can be a dye but is preferably a color pigment. They may include pigments having a color selected from the group consisting of black, white, cyan, magenta, yellow, red, orange, violet, blue, green, brown, and the like. A color pigment may be chosen from those disclosed by HERBST, Willy, et al. Industrial Organic Pigments, Production, Properties, Applications. 3rd edition. Wiley—VCH, 2004. ISBN 3527305769.

Suitable pigments are disclosed in paragraphs [0128] to [0138] of WO 2008/074548 (AGFA GRAPHICS). The pigments are preferably present in the range of 0.01 to 15%, more preferably in the range of 0.05 to 10% by weight and most preferably in the range of 0.1 to 8% by weight, each based on the total weight of the UV inkjet ink.

Belt Step Conveyor System

A preferred embodiment of the UV inkjet printer may comprise a belt conveyor system, wrapped around a porous printing table, it may more preferably comprises a belt step conveyor system as belt conveyor system wherein the conveying belt carries the receiver by moving from a start location to an end location in successive distance movements also called discrete step increments.

UV Bulb Lamps

Many light sources exist in UV radiation, including UV bulb lamps such as high pressure mercury lamp, low pressure mercury lamp or e-beam.

For facilitating curing, a preferred embodiment of the inkjet UV printer preferably includes one or more oxygen depletion units at the UV radiation device (100). A preferred oxygen depletion unit places a blanket of nitrogen or other relatively inert gas (e.g. $CO_2$) with adjustable position and adjustable inert gas concentration, in order to reduce the oxygen concentration in the curing environment. Residual oxygen levels are usually maintained as low as 200 ppm, but are generally in the range of 200 ppm to 1200 ppm.

The UV bulb lamps used in the UV irradiation device of a preferred embodiment of the UV inkjet printer may be primarily gas discharge lamps for use where by the evaporation of metals, a plasma is generated.

Inkjet Print Head

The UV inkjet inks may be jetted by one or more inkjet printing heads ejecting small droplets of ink in a controlled manner through nozzles onto a receiver which is moving relative to the printing head(s). The nozzles in an inkjet printing head are substantially oriented in one or more rows, also called nozzle rows.

A preferred inkjet print head for a preferred embodiment of the UV inkjet printer is a piezoelectric inkjet print head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed or changed in towards the reversed direction, the ceramic expands to its original or even past its original shape, ejecting a drop of ink from the print head. However the UV inkjet printing method according to the present invention is not restricted to piezoelectric inkjet printing. Other inkjet print heads can be used and include various types, such as a continuous type, page-wide inkjet arrays, valve-jet and thermal, electrostatic and acoustic drop on demand type. An example of piezoelectric inkjet print head is disclosed in EP 1911589 (TOSHIBA TEC KK).

Another preferred inkjet print head for a preferred embodiment of the UV inkjet printer is a valve-jet printhead that comprises a plurality of inline jets that are controlled by valves to jet on a receiver. The valves open and shut independently to produce streams of intermittent ink droplets.

Conveyor Belt

A conveyor belt, also called conveying belt, is made of at least one material such as a metal belt. Preferably the conveyor belt includes magnetically attractable material such as a metal conveyor belt and/or the conveyor belt has one layer of a woven fabric web. More preferably the conveyor belt has two or more layers of materials wherein an under layer provides linear strength and shape, also called the carcass and an upper layer called the cover or the support side. The carcass is preferably a woven fabric web and more preferably a woven fabric web of polyester, nylon or cotton. The material of the cover is preferably various rubber and more preferably plastic compounds and most preferably thermoplastic. But also other exotic materials for the cover can be used such as silicone or gum rubber when traction is essential. An example of a multi-layered conveyor belt for a general belt conveyor system wherein the cover having a gel coating is disclosed in US 20090098385 A1 (FORBO SIEBLING GMBH). Preferably the conveyor belt is a glass fabric or the carcass is glass fabric and more preferably the glass fabric has a coated layer on top with a thermoplastic polymer and most preferably the glass fabric has a coated layer on top with polytetrafluoroethylene also called PTFE.

The conveyor belt may also have a sticky cover which holds the receiver on the conveyor belt while it is carried from start location to end location. Said conveyor belt is also called a sticky conveyor belt. The advantageous effect of using a sticky conveyor belt allows an exact positioning of the receiver on the sticky conveyor belt. Another advantageous effect is that the receiver shall not be stretched and/or deformed while the receiver is carried from start location to end location. The adhesive on the cover is preferably activated by an infrared drier to make the conveyor belt sticky. The adhesive on the cover is more preferably a removable pressure sensitive adhesive.

Preferably a conveyor belt is and endless conveyor belt. Examples and figures for manufacturing an endless multi-layered conveyor belt for a general belt conveyor system are disclosed in EP 1669635 B (FORBO SIEBLING GMBH).

Other Preferred Embodiments

A similar apparatus and method may be applied when instead of an UV inkjet varnish an UV inkjet primer is applied on the receiver but the order of applying the liquid layers on the receiver is the opposite than in a preferred embodiment of the UV inkjet printer. In a first passing of the receiver under the inkjet print head module (300) the receiver is primed and in a second passing of the receiver under the inkjet print head module (300) the color or gray image is jetted on the primed receiver. The homogeneity of the UV inkjet primer layer may become important when e.g. a uniform surface tension on the primed receiver is needed to jet the color or gray image on it so a preferred embodiment of the UV inkjet printer is also useful to prime a receiver prior the ink jetting-and-curing passing.

In an preferred embodiment of the UV inkjet printer, the UV inkjet printer comprises:

a cured primer droplet of an UV inkjet ink on the receiver, wherein the varnish droplet is jetted from a first inkjet print head in the inkjet print head module; and the primer droplet is cured in the second irradiation zone; and a cured ink droplet of an UV inkjet ink partially on top of the cured primer droplet, wherein the ink droplet is jetted from a second inkjet print head in the inkjet print head module (300); and the ink droplet is cured in the first irradiation zone.

The jetting and curing of a primer on the receiver while passing the receiver under the inkjet print head module (300) is called the primer jetting-and-curing passing.

The UV inkjet printer of a preferred embodiment may perform thus the following UV inkjet printing method: An UV inkjet printing method in an UV inkjet printer comprising the following steps:

a) performing a second printing configuration by:

a1) if a first shutter means of an UV radiation device (100) is open, close the first shutter means of the UV radiation device (100); and a2) if a second shutter means of the UV radiation device (100) is closed, open the second shutter means of the UV radiation device (100); and a3) create a second irradiation zone by the closed first shutter means and the open second shutter means on an receiver of the UV inkjet printer; an a4) jetting an UV inkjet primer on the receiver of the UV inkjet printer; and a5) irradiating the jetted UV inkjet primer in the second irradiation zone; and b) performing a first printing configuration by:

b1) opening the first shutter means of the UV radiation device (100); and b2) create a first irradiation zone by the open first shutter means and open second shutter means on an receiver of the UV inkjet printer; and b3) jetting an UV inkjet ink to the receiver of the UV inkjet printer on top of the cured UV inkjet primer; and b4) irradiating the jetted UV inkjet ink in the first irradiation zone.

Another preferred embodiment in the present invention is a shutter system (200) for an UV radiation device (100) comprising an UV bulb lamp n the shutter system (200) is characterized to switch from a first irradiation zone to a second irradiation zone and wherein the shutter system (200) comprises a controlling means wherein the controlling means of the shutter system (200) controls the dimension of the first and second irradiation zone in a direction parallel to the length of the UV bulb lamp. The controlling of the dimensions of both irradiation zones is an advantage to control the amount of irradiation and the place of the irradiation zones.

The UV radiation device (100) with the shutter system (200) of the present invention is preferably comprised in an UV inkjet printer, more preferably in a wide-format UV inkjet printer. The advantage of such shutter system (200) in an UV inkjet printer is the possibility to enlarge the time-to-cure or to shorten the time-to-cure by changing the dimensions. The UV inkjet printer in this preferred embodiment may comprise in its inkjet print head module (300), an inkjet print head that jets a varnish or a primer, next to an inkjet print head that jets a color UV inkjet ink. If the UV inkjet printer is a wide-format UV inkjet printer, the length of the UV bulb lamp is parallel to the slow-scan direction of the wide-format UV inkjet printer wherein also the nozzle-row column of a comprised inkjet print head in its inkjet print head module (300) is parallel to the slow-scan direction.

In a preferred embodiment of this shutter system (200), the shutter system (200) may comprise, a second shutter means to create the second irradiation zone when the second shutter is open; and a first shutter means to create together with the open second shutter means the first irradiation zone when the first shutter is open.

REFERENCE SIGNS LIST

TABLE 1

| | |
|---|---|
| 1 | wide-format UV inkJet printer |
| 5 | conveyor belt |
| 100 | UV radiation device (100) |
| 101 | UV bulb lamp |
| 200 | shutter system (200) |
| 201 | shutter means |
| 202 | shutter means |
| 203 | Shutter means |
| 204 | Pivotal means |
| 205 | Engaging means |
| 300 | InkJet print head module (300) |
| 301 | UV inkjet print head to jet an UV inkjet ink |
| 302 | UV inkjet print head to jet an UV inkjet varnish |
| 311 | Dimension along slow-scan direction of the UV inkjet ink print zone |
| 312 | Dimension along slow-scan direction of the UV inkjet varnish print zone |
| 350 | Fast-scan direction (forth and back) |
| 370 | Slow-scan direction |
| 400 | Dimension along slow-scan direction of the irradiation zone |

The invention claimed is:

1. An inkjet printer comprising:

an inkjet print head module; and an ultraviolet radiation device attached to the inkjet print head module and that irradiates an irradiation zone on a receiver; wherein the ultraviolet radiation device includes an ultraviolet bulb lamp and a shutter system, the shutter system including:

a controller that changes a dimension of the irradiation zone in a slow scan direction, which is a direction that the receiver moves, between a first irradiation zone on the receiver and a second irradiation zone on the receiver;

a first shutter; and a second shutter;

the first shutter and the second shutter are positioned in a single row parallel with the slow scan direction; and the first irradiation zone is defined by the first shutter and the second shutter being open, and the second irradiation zone is defined by the first shutter being closed and the second shutter being open.

2. The inkjet printer according to claim 1, wherein the controller switches between a first printing configuration in which the first shutter and the second shutter are open and a second printing configuration in which the first shutter is closed and the second shutter is open.

3. The inkjet printer according to claim 2, further comprising a rotator that rotates the ultraviolet radiation device through a rotation angle around an axis parallel to the slow scan direction while changing to the second printing configuration; wherein the rotation angle is smaller than or equal to 45 degrees in a direction away from the inkjet print head module.

4. The inkjet printer according to claim 1, wherein the shutter system includes:

a driver that opens and closes one of the first shutter and the second shutter; and an engagement that engages the driver to open and close the other of the first shutter and the second shutter simultaneously with the one of the first shutter and second shutter, and that disengages from the driver so that the other of the first shutter and the second shutter remains closed.

5. The inkjet printer according to claim 1, wherein a dimension of a printing zone of the inkjet print head module along the slow scan direction is smaller than or equal to a dimension of the first irradiation zone along the slow scan direction; and the first irradiation zone overlaps the printing zone in the slow scan direction.

6. The inkjet printer according to claim 1, wherein an ink droplet of ultraviolet inkjet ink is jetted onto the receiver from a first inkjet print head in the inkjet print head module, and the ink droplet is cured in the first irradiation zone; and a varnish droplet of an ultraviolet inkjet varnish is jetted at least partially on top of the cured ink droplet, wherein the varnish droplet is jetted from a second inkjet print head in the inkjet print head module, and the varnish droplet is cured in the second irradiation zone.

7. The inkjet printer according to claim 1, wherein the second irradiation zone has a smaller dimension in the slow scan direction than the first irradiation zone.

8. An inkjet printing method comprising the steps of:

providing an ultraviolet radiation device including a first shutter and a second shutter, the first shutter and the second shutter being positioned in a single row parallel with a slow scan direction, which is a direction that a receiver moves;

a) providing a first printing configuration by performing the steps of:

a1) opening the first shutter of the ultraviolet radiation device;

a2) opening the second shutter of the ultraviolet radiation device;

a3) creating a first irradiation zone on the receiver by opening the first shutter and the second shutter;

a4) jetting an ultraviolet inkjet ink onto the receiver; and a5) irradiating the jetted ultraviolet inkjet ink in the first irradiation zone; and b) providing a second printing configuration by performing the steps of:

b1) closing the first shutter of the ultraviolet radiation device;

b2) creating a second irradiation zone on the receiver by closing the first shutter and opening the second shutter;

b3) jetting an ultraviolet inkjet varnish on the receiver; and b4) irradiating the jetted ultraviolet inkjet varnish in the second irradiation zone.

9. The inkjet printing method according to claim 8, further comprising the step of:

changing a dimension of one of the first irradiation zone and the second irradiation zone in the slow scan direction.

10. The inkjet printing method according to claim 8, further comprising the steps of:

using a driver to open and close the first shutter; and engaging the second shutter with the driver to open and close the second shutter simultaneously with the first shutter, or disengaging the second shutter from the driver to keep the second shutter closed.

11. The inkjet printing method according to claim 8, further comprising, prior to the step b3, the step of:

wiping the receiver with a fluid selected from ethanol, isopropanol, methanol, acetone, or alcohol.

12. The inkjet printing method according to claim 8, further comprising a step:

rotating the ultraviolet radiation device through a rotation angle around an axis parallel with a slow scan direction, which is a direction that the receiver moves, wherein the rotation angle is smaller than or equal to 45 degrees in a direction away from an inkjet print head module while changing to the second printing configuration.

13. The inkjet printing method according to claim 8, further comprising the step of:

controlling a temperature of the first shutter and the second shutter differently.

14. The inkjet printing method according to claim 8, wherein the second irradiation zone has a smaller dimension in the slow scan direction than the first irradiation zone.

* * * * *